United States Patent [19]

Dvorak et al.

[11] 4,419,863

[45] Dec. 13, 1983

[54] FUEL-AIR MIXING APPARATUS

[75] Inventors: Herman G. Dvorak, Manchester; Robert D. Klapatch, Kensington; Sid Russell, Suffield; Louis J. Spadaccini, Manchester, all of Conn.

[73] Assignee: United Technologies Corporation, Hartford, Conn.

[21] Appl. No.: 307,124

[22] Filed: Sep. 30, 1981

[51] Int. Cl.[3] ..... F02C 1/00

[52] U.S. Cl. ..... 60/748; 60/751

[58] Field of Search ..... 60/737, 739, 748, 751, 60/752, 755, 756, 757

[56] References Cited

U.S. PATENT DOCUMENTS 2,617,255 11/1952 Nichus ..... 60/748
2,664,702 1/1954 Lloyd et al. ..... 60/752
3,853,273 12/1974 Bahr et al. ..... 60/748
4,194,358 3/1980 Stenger ..... 60/748

*Primary Examiner*—Louis J. Casaregola
*Assistant Examiner*—Timothy S. Thorpe
*Attorney, Agent, or Firm*—Robert C. Walker

[57] ABSTRACT

Apparatus for mixing fuel and air for combustion in a gas turbine engine is disclosed. Various construction details capable of reducing pollutant emissions in the engine exhaust are discussed. In detailed form scoops 20 at the upstream end of the combustion chamber 12 provide uniform flow about the fuel nozzles. Deflectors 26 downstream of the fuel nozzles collimate the scooped air to aerodynamically confine the mixing fuel and air. Premature spreading of the fuel and air before nearly homogeneous fuel-air ratios are achieved is inhibited.

4 Claims, 3 Drawing Figures

FUEL-AIR MIXING APPARATUS

DESCRIPTION

1. Technical Field

This invention relates to gas turbine engines and more specifically to the combustion sections of such engines.

2. Background Art

Within the gas turbine engine field, combustion processes are among the most difficult phenomena to describe and predict. Accordingly, over the last four decades, combustion apparatus has gone through dramatic alteration after alteration as new scientific theories and techniques are advanced.

The literature is replete with various showings, in detail and otherwise, illustrative of prior tried concepts. Various baffles, swirlers and deflectors are shown in what appears to be every conceivable form. Yet, increasingly stringent environmental standards are causing designers and developers of gas turbine engines to search for further improved concepts.

Typically, in a gas turbine engine, fuel is sprayed into the combustion chamber through a pressure atomizing type or an aerating type fuel nozzle. The fuel is discharged from the nozzle in a conical spray pattern of increasing diameter as the fuel progresses downstream from the fuel nozzle. Air is flowed in swirling motion around the conical spray and is resultantly mixed with fuel. Local regions of rich fuel-air ratio develop both about the interior and exterior of the cone. Upon the occurrence of combustion visible smoke and/or other pollutants are likely to be produced.

The problem of pollutants is particularly difficult to treat in land based industrial engines which operate on commercial grade distillate fuels having API (American Petroleum Institute) gravity on the lower end of the thirty (30) to forty-five (45) range. Low API gravity fuels have higher aromatic hydrocarbon content. Smoke may be formed as a result of lower amounts of fuel hydrogen and highly complex molecular ring structures in such fuels. Additionally, low volatility and high viscosity in such fuels lead to less efficient combustion. An API gravity fuel of thirty-five (35) or less, corresponding to a specific gravity of eighty-five hundredths (0.85), is representative of poorer grade distillates which commonly produce visible emissions.

A significant portion of such visible emissions result from excessively high equivalence ratios. Combustion at local equivalence ratios (actual fuel-air ratio/stoichiometric fuel-air ratio) on the order of one and two tenths (1.2) or greater may generate smoke and combustion at local ratios in excess of two (2.0) is likely to be visibly offensive.

Visible pollutants may also emit from engines operated on gaseous fuels, such as natural gas. In such engines a yellowish plume is thought to be indicative of nitrogen dioxide presence.

Substantial efforts have been devoted in the industrial gas turbine engine industry to the reduction of pollutants emanating from engines run on both liquid and gaseous fuels.

DISCLOSURE OF INVENTION

According to the present invention local fuel-air ratios immediately downstream of the fuel nozzles of a gas turbine engine are reduced by scooping air into the fuel discharge regions and confining said air with the discharged fuel in essentially collimated streams such that spreading of the fuel-air stream is inhibited.

Primary features of the present invention include the air scoops upstream of the combustion chamber and the cylindrical baffle extending downstream from the plane of fuel nozzle discharge. The cylindrical baffle is of short axial length so as to remain spaced from the zone of combustion, yet is sufficiently long to cause aerodynamic turning of the air stream and the fuel constrained thereby. An essentially collimated stream of mixing fuel and air results.

A principal advantage of the present invention is the capability of the structure to encourage fuel-air mixing without local regions of excessive fuel-air ratio. The fuel and combustion air are confined in a constrained column inhibitive of premature spreading. The avoidance of spreading increases the concentration of combustion air adjacent the fuel and retards the quenching rate. Collimating the fuel and air as described has the additional benefit of keeping combustion products away from the walls of the combustion chambers, allowing the chamber walls to run cooler and extending the life of the chamber.

The foregoing, and other objects, features and advantages of the present invention will become more apparent in the light of the following detailed description of the preferred embodiment thereof as shown in the accompanying drawing.

BEST MODE FOR CARRYING OUT THE INVENTION

The concepts of the present invention were developed and tested in an industrial gas turbine engine running on commercial grade distillate fuel having an API gravity of thirty-three and five tenths (33.5).

Figure 1:
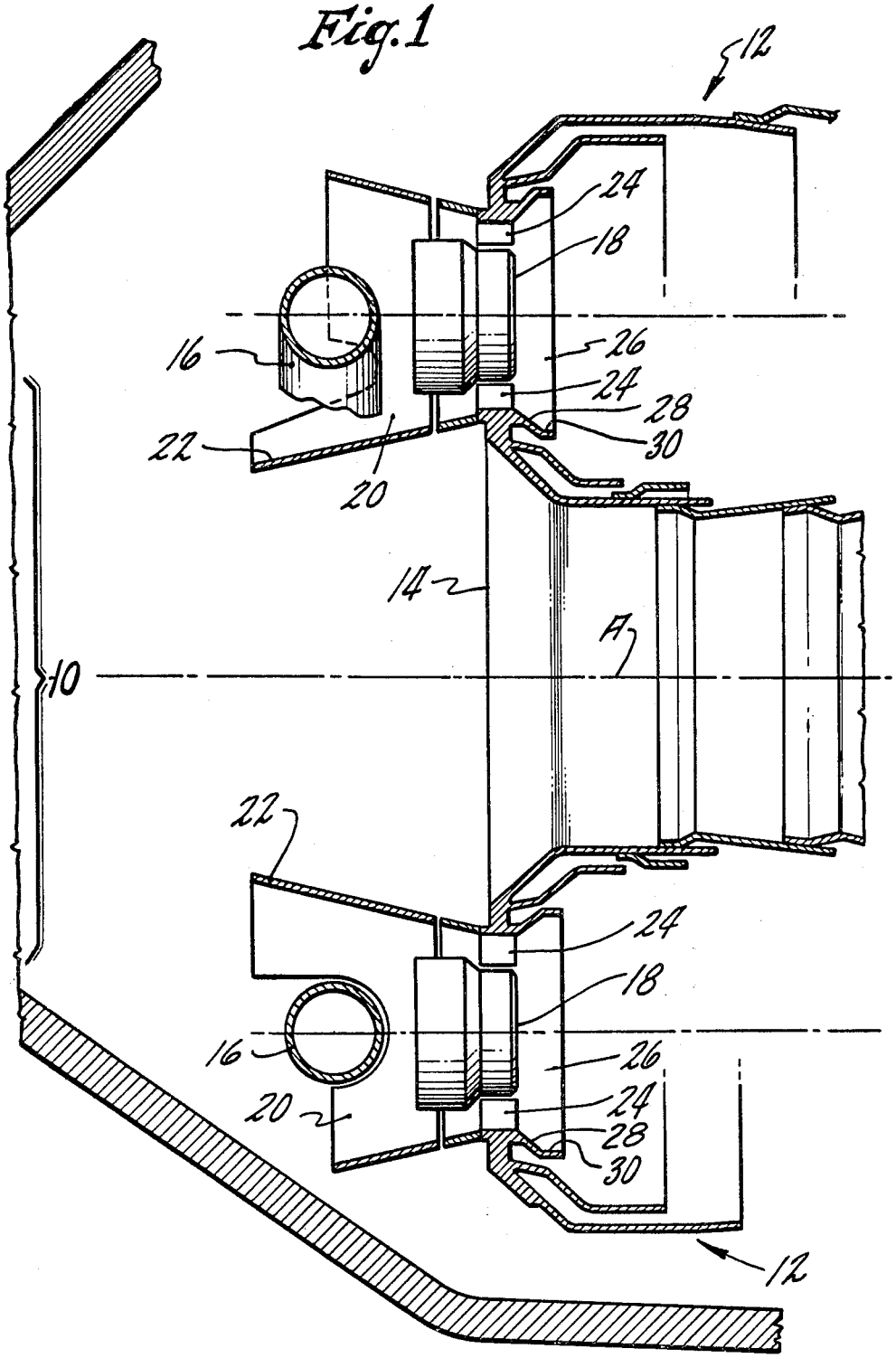
FIG. 1 is a simplified side cross section view of a gas turbine engine showing diffusion and combustion sections.

A portion of the engine is shown in simplified cross section in FIG. 1. The engine includes an annular diffuser 10 centered about the engine axis not illustrated. A plurality of essentially cylindrical combustion chambers, as represented by the single chamber 12, are disposed in annular array about the engine axis downstream of the diffuser. The axis A of the single combustion chamber is indicated. Fuel is flowable to the upstream end 14 of the combustion chamber through the fuel manifold 16.

Figure 2:
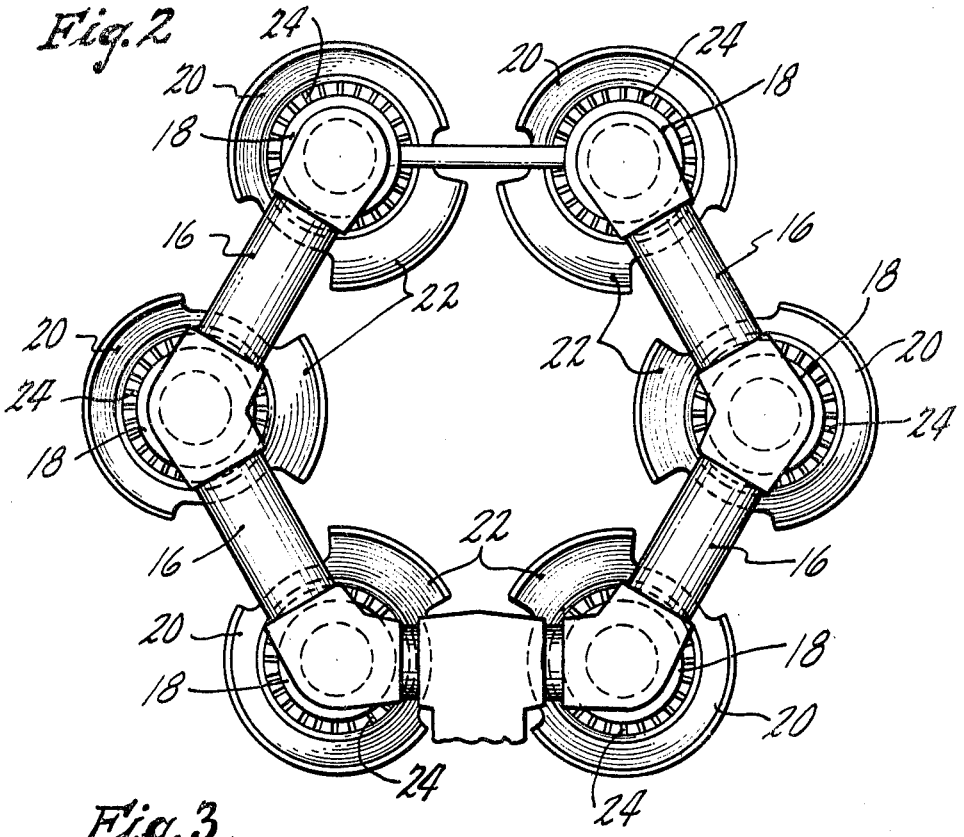
FIG. 2 is a simplified front view of a combustion chamber showing air scoops disposed about each fuel nozzle.

As is illustrated in FIG. 2, the fuel manifold 16 distributes fuel to a plurality of fuel nozzles 18. The fuel nozzles illustrated are of the aerating type although it is expected that pressure atomizing nozzles may be employed in some embodiments. A corresponding plurality of air scoops 20 are disposed one each about each of the fuel nozzles. The scoops illustrated approximate the geometry of a truncated cone with the wider end of the cone facing the diffuser and the narrower end of the cone circumscribing the corresponding fuel nozzle. The scoops are capable of directing air from the diffuser of an operating engine to an annular stream about the fuel nozzle. The geometry of the truncated cones may be further modified to extend along one side thereof a greater distance toward the diffuser, for example in the cone region 22 nearest the combustion chamber axis. In such an embodiment the cone is capable of intercepting greater amounts of diffuser air in that region in order to mitigate the effects of downstream perturbations in air flow approaching the combustion chamber. An air swirler 24 is disposed across the annular air stream emanating from the scoops and is capable of imparting a rotational component to air flowing thereacross for swirling said air about the fuel dischargeable from the nozzles 18.

Further illustrated is an air deflector 26 or baffle extending into the combustion chamber from the swirler for deflecting flow thereacross. The deflector is formed of two portions: a truncated conical portion 28 opening in the downstream direction and a cylindrical portion 30 extending a short distance downstream from the conical portion.

Figure 3:
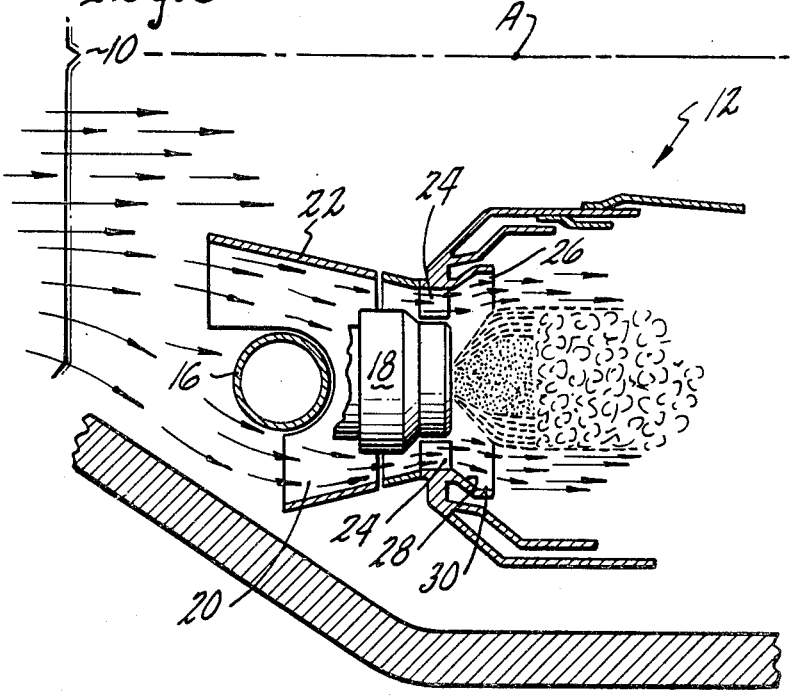
FIG. 3 is a schematic illustration of fuel and air flow about the fuel nozzle, specifically showing collection of air upstream of the fuel nozzle and redirection of the fuel and air to an essentially cylindrical column downstream of the fuel nozzle.

Operation of the apparatus is best understandable by viewing the schematic representation of fuel-air mixing, flow and subsequent combustion illustrated in FIG. 3. Air discharging from the diffuser section of the engine is represented by the arrows upstream of the scoop 20. The air flows in an annular stream toward the combustion chamber. The smoothest and most concentrated flow occurs toward the axis A of the combustion chamber. A greater arrow density in that region illustrates this concentration. A single fuel nozzle is illustrated below the axis A. The scoop 20 associated with that nozzle extends forward from the upstream end of the combustion chamber and opens in conical form to a wider frontal area with respect to approaching flow. Additionally, the scoop extends upstream of the fuel manifold 16 to a region relatively free of structural proturberances capable of causing flow distortions. In the construction illustrated herein the scoops have an arcuate portion 22 extending in an upstream direction relative to the remaining portion thereof and capable of intercepting additional flow near the axis A of the combustor. The extension of the scoops toward the axis A is most readily viewable in FIG. 2.

Each scoop collects air discharging from the diffuser, distributes and directs the flow around the associated fuel nozzle. Flow discharges across the swirlers 24 which impart a rotational component of velocity to the air. The rotational velocity encourages the mixing of the air with fuel discharging from the fuel nozzle.

In accordance with a second aspect of the invention the deflectors 26 downstream of the swirlers 24 and fuel nozzles 18 each are formed of a conical portion 28 and an essentially cylindrical portion 30. Expansion of the fuel-air mixture in the conical section encourages initial atomization of the fuel. The fuel-air mixture is collimated as the mixture passes through the cylindrical portion. Immediately downstream of the deflector aerodynamic effects hold the fuel-air mixture in an essentially collimated form as the mixture progresses toward the combustion zone.

Aerodynamic confinement as a result of redirection by the essentially cylindrical portion of the deflector turns the air flow as indicated forming a cylindrical curtain against which discharging fuel droplets impinge: shearing effects enhance atomization. The fuel droplets are carried with the air in the downstream direction where mixing occurs with only limited spreading. Good homogeneity of the fuel-air ratio results and locally excessive fuel-air ratios are substantially avoided. The fuel-air ratio is predictable and uniform. Prior variations in combustion fuel-air ratio from nozzle to nozzle, and indeed within the spray pattern at each nozzle are significantly reduced.

An additional benefit of collimating and aerodynamically confining the fuel-air mixture is a retardation of the rate at which the temperature of the mixture is quenched by supplemental combustion and dilution air. Improved vaporization results from higher temperatures during fuel-air mixing. Harmful effects as a result of slow carbon particle burnout are substantially avoided.

Although the invention has been shown and described with respect to preferred embodiments thereof, it should be understood by those skilled in the art that various changes and omissions in the form and detail thereof may be made therein without departing from the spirit and the scope of the invention.

What is claimed is:

1. In combustion apparatus of the gas turbine engine type including a combustion chamber and a fuel nozzle at the upstream end of the combustion chamber for injecting fuel into said chamber, the improvement comprising:

an air scoop of essentially truncated conical geometry disposed about the fuel nozzle and facing away from the upstream end of the combustion chamber for collecting air at the upstream end of the combustion chamber and directing said air into an annular stream about said fuel nozzle including an arcuate portion extending in an upstream direction relative to the remaining portion thereof and capable of intercepting flow approaching the conical air scoop;

an air swirler disposed about said fuel nozzle for receiving the annular stream of air and imparting a rotational component of velocity to the air for encouraging mixing of the air and fuel which is dischargeable from the fuel nozzle and a flow directing baffle disposed immediately downstream of said swirler and fuel nozzle for receiving fuel and air dischargeable therefrom including a truncated conical portion opening into the combustion chamber and a cylindrical portion extending downstream into the combustion chamber from the conical portion for forming said fuel and air into an aerodynamically confined column inhibitive of premature spreading of the fuel-air mixture.

2. The invention according to claim 1 which further includes a plurality of said fuel nozzles disposed at the upstream end of said combustion chamber and wherein each of said nozzles has an air scoop, swirler and flow directing baffle associated therewith.

3. In combustion apparatus of the gas turbine engine type including a combustion chamber having a plurality of circumferentially spaced fuel nozzles centered in a pattern about the axis of the combustion chamber, the improvement which comprises:

a plurality of air scoops corresponding in number to the number of fuel nozzles and of essentially truncated conical geometry each centered about a corresponding fuel nozzle wherein each of said scoops has an extended arcuate portion in the region nearest said combustion chamber axis for intercepting air flow approaching the chamber along the axis.

4. The invention according to claim 3 which further includes a deflector extending downstream of the fuel nozzle and which is capable of receiving air from said scoops and collimating the air around fuel dischargeable from the corresponding fuel nozzle.

* * * * *